US011014706B2

(12) United States Patent
McGee et al.

(10) Patent No.: US 11,014,706 B2
(45) Date of Patent: May 25, 2021

(54) OPENING CONFIGURATION FOR SHRINK-WRAPPED PACKAGE

(71) Applicant: Apple Inc., Cupertino, CA (US)

(72) Inventors: Kelly B. McGee, Sunnyvale, CA (US); Derek Bowman Pincus, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/392,277

(22) Filed: Apr. 23, 2019

(65) Prior Publication Data

US 2019/0337672 A1 Nov. 7, 2019

Related U.S. Application Data

(60) Provisional application No. 62/702,758, filed on Jul. 24, 2018, provisional application No. 62/665,393, filed on May 1, 2018.

(51) Int. Cl.

| | |
|---|---|
| ***B65D 17/353*** | (2006.01) |
| ***B65D 17/28*** | (2006.01) |
| ***B65D 65/22*** | (2006.01) |

(52) U.S. Cl.

CPC ..... *B65D 17/353* (2018.01); *B65D 17/402* (2018.01); *B65D 17/404* (2018.01); *B65D 65/22* (2013.01); *B65D 2517/0013* (2013.01); *B65D 2565/381* (2013.01)

(58) Field of Classification Search

CPC .... B65D 17/353; B65D 17/40; B65D 17/402; B65D 17/404; B65D 65/02; B65D 75/002; B65D 75/58; B65D 75/5805; B65D 75/5827; B65D 75/5833; B65D 75/5838; B65D 75/5844; B65D 77/00;

(Continued)

(56) References Cited

U.S. PATENT DOCUMENTS 3,175,752 A * 3/1965 Stabenow ..... B65D 75/5838 229/87.05

3,273,302 A * 9/1966 Walter ..... B65B 61/02 53/412

(Continued)

FOREIGN PATENT DOCUMENTS

GB 1564772 A 4/1980

*Primary Examiner* — Bryon P Gehman

(74) *Attorney, Agent, or Firm* — Sterne, Kessler, Goldstein & Fox P.L.L.C.

(57) ABSTRACT

Non-crosslinked polyolefin films or doped crosslinked polyolefin films (i.e., crosslinked polyolefin films that include a tear-alignment additive) may be used to shrink-wrap packages to create a wrapped package that is protected from tampering and damage but is also easy to open with little effort required by the customer. There is no need for perforations, and the films are quiet when torn, folded, cut, etc. Tear initiating cuts may be formed in the film. A tab may be placed over the film, and when the tab is pulled it applies enough force to start a pair of straight tears. The tears may be parallel or perpendicular to each other. The tears propagate in non-crosslinked polyolefin easily in the machine direction of the film as the tab continues to be pulled. In a doped crosslinked polyolefin, the tears propagate in the machine direction or perpendicular to the machine direction of the film.

26 Claims, 8 Drawing Sheets

(58) Field of Classification Search
CPC ..... B65D 77/003; B65D 2517/0013; B65D 2565/381; B65D 17/28; B65D 65/22
USPC ..... 206/469, 497; 229/87.05; 383/200–210
See application file for complete search history.

(56) References Cited

U.S. PATENT DOCUMENTS 3,344,975 A * 10/1967 Stoker, Jr. ..... B65D 75/58 229/87.05
3,403,840 A * 10/1968 Howard ..... B65D 75/66 206/497
3,442,436 A 5/1969 Kirby, Jr.
4,188,443 A * 2/1980 Mueller ..... B29C 55/023 428/216
4,781,294 A * 11/1988 Croce ..... B65D 33/1691 383/201
5,067,612 A * 11/1991 Tsuchiya ..... B65D 75/5844 206/497
5,375,718 A * 12/1994 Honma ..... B65D 75/66 206/497
5,423,423 A * 6/1995 Sato ..... B65D 75/5844 229/87.05
5,518,119 A * 5/1996 Takahashi ..... B65D 75/002 206/497
5,556,674 A * 9/1996 Meilhon ..... B32B 27/08 206/497
6,006,907 A * 12/1999 Sato ..... B65D 75/5844 206/497
7,216,764 B2 * 5/2007 Forman ..... B65B 61/184 206/497
8,342,389 B2 * 1/2013 Mills ..... B65D 75/5844 229/87.05
9,561,889 B2 * 2/2017 Dayrit ..... B32B 27/20
10,189,621 B2 * 1/2019 Dayrit ..... B32B 27/08
10,202,229 B2 * 2/2019 Huerta ..... B32B 27/08
2014/0231493 A1 8/2014 Andersen et al.

* cited by examiner

OPENING CONFIGURATION FOR SHRINK-WRAPPED PACKAGE

CROSS-REFERENCE TO RELATED APPLICATIONS

This application claims the benefit of U.S. Provisional Patent Application No. 62/665,393, filed May 1, 2018, and U.S. Provisional Patent Application No. 62/702,758, filed Jul. 24, 2018, each of which is incorporated herein in its entirety by reference thereto.

FIELD

The described embodiments relate generally to shrink-wrap films used for packaged products. More particularly, the embodiments relate to non-crosslinked polyolefin shrink-wrap films and doped crosslinked polyolefin films.

BACKGROUND

Many consumer products, including their packaging, are wrapped in a thin film that can protect the product from damage during shipping and discourage tampering with the product before it is sold. The thin film may be the customer's first interaction with the product.

SUMMARY

Various embodiments are disclosed that relate to polyolefin (POF) shrink-wrap film (e.g., non-crosslinked POF shrink-wrap film or doped crosslinked-POF) and methods of shrink wrapping products with such films. The POF films can be removed by a customer by pulling a tab that propagates a pair of straight, parallel tears along the length of an underlying box, package, or product.

In some embodiments, shrink-wrapped packaged products as described herein may be a packaged in a box that is shrink wrapped with a non-crosslinked POF shrink-wrap film. The shrink-wrap film may include a first cut and a second cut in the film, each oriented in the machine direction of the shrink-wrap film. A third cut in the film may be oriented perpendicular to the machine direction and may connect to and extend between the first and second cuts. A tab may be affixed to the film, extending between the first and second cuts and overlying the first, second, and third cuts. When the tab is pulled, a tear forms at each of the first and second cuts and both tears propagate in straight, parallel lines in the machine direction of the shrink-wrap film.

In some embodiments, shrink-wrapped packaged products as described herein may be packaged in a packaging container that is shrink-wrapped with a POF shrink-wrap film that that covers the packaging container. The shrink-wrap film may include a pair of tear-initiating cuts. In some embodiments, the tear-initiating cuts are each disposed adjacent to an edge of the packaging container. Each tear-initiating cut may extend in a machine direction of the shrink-wrap film. A connecting cut extends between and connects to each of the pair of tear-initiating cuts. In response to a force applied to the shrink-wrap film between the tear-initiating cuts in a direction away from the packaging container, the shrink-wrap film tears from the pair of tear-initiating cuts to create a pair of parallel tear paths extending in the machine direction of the shrink-wrap film.

In some embodiments, methods of shrink-wrapping a box include wrapping the box with a POF film, and then heating the film to shrink wrap the film around the box, which creates high-strain areas in the machine direction of the film at edges of the box. The method also includes cutting two tear-initiating cuts through the film. When a non-crosslinked POF is used, the tear-initiating cuts may be oriented in the machine direction of the film and within the high-strain areas. When a doped crosslinked POF is used, the tear-initiating cuts may be oriented in the machine direction of the film and/or in perpendicular to the machine direction of the film. After cutting, the method includes applying a tab to the film, covering the tear-initiating cuts. The tear-initiating cuts propagate linear, parallel tears in the machine direction of the film when the tab is pulled.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
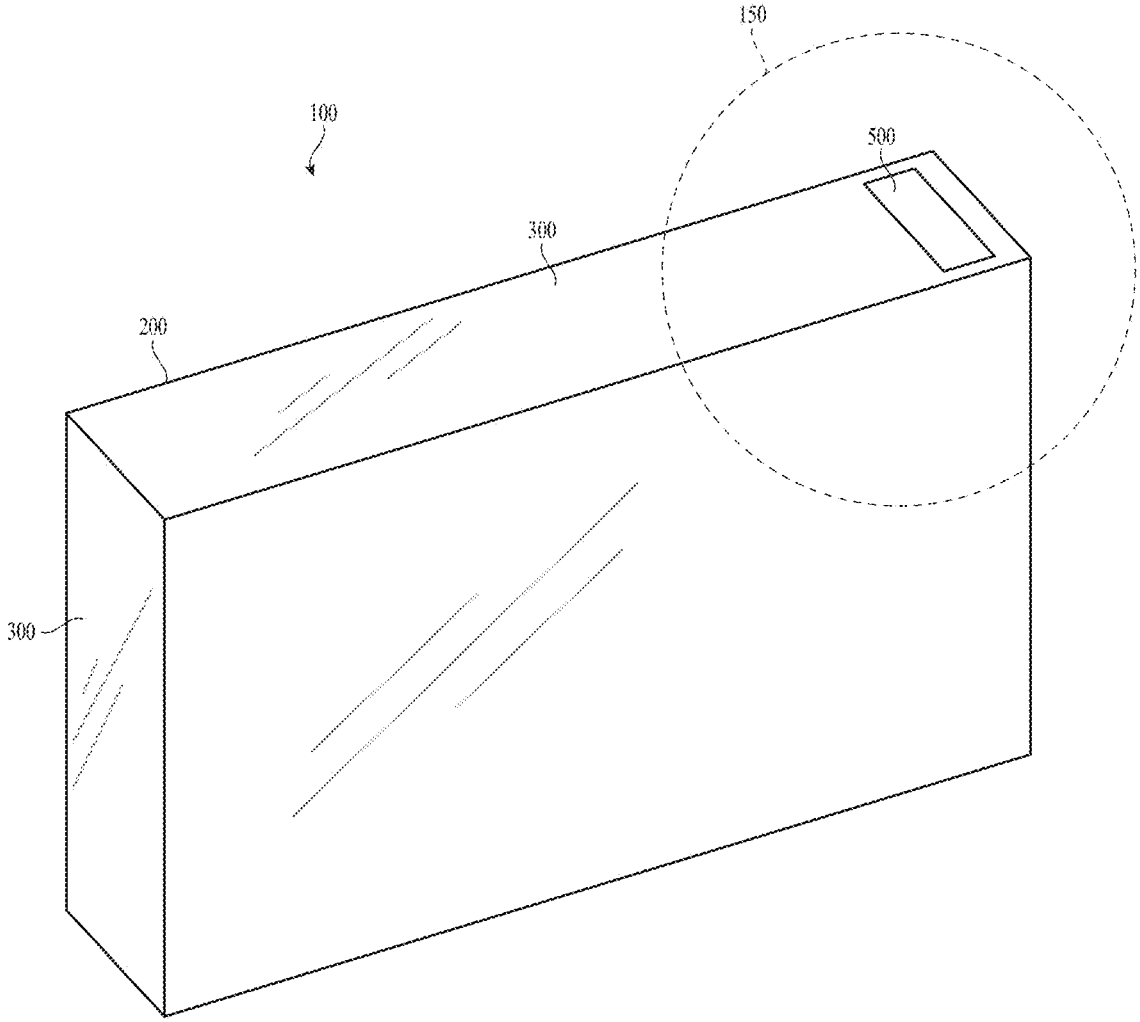
FIG. 1 shows an example product package covered by a polyolefin shrink-wrap film.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Many consumer products, including their packaging, are wrapped in a thin, clear, shrink-wrap film that can protect the product or the packaging from damage during shipping and inhibit tampering with the product before it is sold. A customer's first experience with a product may be removing this film. Existing methods for shrink wrapping an item use substances, for example PET (polyethylene terephthalate), that are crinkly and hard, which makes them noisy and difficult to open. Other methods for shrink wrapping use substances, such as OPP (oriented polypropylene), that are less noisy and softer than PET but are very costly and use more plastic than POF. Additionally, many of these films may require the use of a tool, such as scissors, a key—or even a customer's fingernails—to remove the shrink-wrap film. Some of these films can be perforated to ease the opening process, but tearing the perforation still creates a noisy, repeated popping sound and is prone to failure if the tear paths deviate from the perforations. Additionally, the process of creating the perforations in the film can sometimes cause damage the underlying package, since shrink-wrap film is in such close contact with its underlying packaging.

To improve a customer's experience when removing a product's outer film, the present inventors have uncovered and leveraged unexpected properties of films with a strong linear characteristic, such as an oriented polymer with no crosslinks (e.g., non-crosslinked polyolefin (POF)) and doped crosslinked films (e.g., crosslinked POF including a tear-alignment additive). As discussed in detail below, such films may be applied and processed in a way that makes them easily removed from the packaging in a clean, controlled manner without tools and without perforations. For example, a non-crosslinked POF film or a doped crosslinked POF film applied in accordance with embodiments of the invention allows a customer to easily separate a strip or panel of the film along straight tear lines, thereby removing the film in a clean, continuous manner with little effort, while providing a consistent tactile feedback with minimal noise. POF is less noisy than PET, and thus will not crinkle as much. Further, by not making use of a perforation as would be needed to control tear paths in other materials, such non-crosslinked POF and doped crosslinked POF do not present the typical noisy, grating sound attendant to tearing along a perforation. These polyolefin films also provide a less expensive alternative to OPP.

To make the shrink-wrap film easy to open, the film may include a tab and a series of cuts in the film that create a cut geometry that acts as a guide to start the tearing of the film. A tab may be positioned to cover the cut geometry and to provide a place for a customer to pull to remove the shrink-wrap film. When using non-crosslinked POF, when the film is wrapped around the packaging a high-strain area is formed at the edges of the package. The inventors have discovered that the high-strain area in non-crosslinked POF promotes the propagation of tear paths in straight lines from the cut geometry and along the length of the package when the intended tear line direction coincides with the machine direction of the POF film.

In some embodiments, the shrink-wrap film may be a crosslinked POF that has been doped with a tear-alignment additive that causes tears to propagate in straight lines. Like the non-crosslinked POF, the doped crosslinked POF may be wrapped around the packaging, and a series of cuts in the film may create a cut geometry. The doped crosslinked POF, however, is tension independent and will tear in straight lines both in the direction of the machine direction of the POF film and perpendicular to the machine direction of the POF film.

Thus, when either a non-crosslinked POF or a doped crosslinked POF is used to shrink-wrap a package, the customer can easily remove the shrink wrap in a controlled manner with less noise and effort by simply pulling the film or the tab and tearing in straight lines without the use of perforations or other structure aiding the removal process.

Existing methods for shrink-wrapping a package use various types of film, such as polyethylene terephthalate (PET), oriented polypropylene (OPP), and traditional crosslinked polyolefin (POF) (e.g., crosslinked POF film that has not been doped with a tear-alignment additive). These films have properties that make them conducive to use in the context of consumer packaging. For example, PET has high tensile strength, which allows for the use of thin films, and it is relatively inexpensive. OPP is less noisy than PET, and it is strong and stable in a wide range of temperatures. And traditional crosslinked POF has a high tensile strength, is durable, and is puncture resistant. However, each also has disadvantages that have been identified and overcome by the inventors. For example, PET is a stiff material that can be slippery when handled. Removal of the PET creates loud, crinkly noises as it is torn, cut, folded, or otherwise removed. OPP provides a less noisy alternative to PET, but OPP is relatively expensive. Because of the large number of consumer products that are manufactured and wrapped in a shrink-wrap film prior to being sold, at scale the expense of OPP can be a significant factor for use of OPP on consumer packaging. And as for traditional crosslinked POF, controlling tear paths can require noisy and unsightly perforations.

In many cases, shrink-wrapped packages are wrapped in film without any specific structure included for removing the film. In these cases, the customer may resort to use of a tool or significant force to remove the film. For example, a customer may use scissors, knives, or other tools to tear a hole into the film and start the removal process. In other cases, a customer may use a fingernail to break a hole in the film. Without tools or a sharp fingernail, the user is left with simply pulling film away from the box, which stretches the film until its breaking point, assuming that the customer is strong enough to do so. Once a customer has applied significant force and the film has been pulled and stretched enough, a hole or tear may form in the film that can start the removal process. Regardless whether the customer uses tools or a hand to remove the film, the customer's initial interaction with the packaging is marked by a noisy struggle to remove the film. So even though the film serves to protect underlying package, the film also provides an impediment to the customer reaching the contents of the package.

In some cases, to aid in the removal of the film, perforations are added to the shrink-wrap film. There are several disadvantages to perforations that may be negative to a high-end retailer or customer. For example, perforations alter the visual aspect of the packaging: a customer can see the perforations in the film, which distracts from the underlying package or box. Another disadvantage is the undesirable noise created when the customer removes the perforations by pulling and breaking the gaps in the perforations. With every advance in tearing or breaking of the perforations, a customer is met with a loud "pop" noise related to breaking the perforations, in addition to any noise created by the film itself due to crinkling, tearing, etc. Further, perforations can have a high failure rate, and once a tear path deviates from its perforation the tear strip can tear off entirely, leaving a customer with only a partially-opened package, left to figure out another way to get it open.

In addition to the undesirable user experience related to perforations, creating the perforations in the shrink-wrapped film presents numerous challenges. Creating the perforations requires the use of tools, such as knives, to cut the perforations in the film. But using such tools risks damage to the underlying box.

Some other existing opening techniques include films used for sealed bags (e.g., snack bags, potato chip bags, etc.) that include a small cut in one or more of the seals. These bags generally include two polymer films that are heat sealed together, and the heat-sealed portion includes a small cut that serves to break the seal. For example, a potato chip bag may have a small cut in the seal to help a customer tear through the seal at the cut to remove a corner of the bag to access the potato chips. Notwithstanding the material issues described above related to PET and OPP, these types of cuts still have many downsides, including the fact that two hands may be required to break the seal. The customer must use one hand of either side of the cut, then pull in opposite directions to break the seal and access the packaged product. These types of cuts also are not possible to use to open a single side of the packaging, and must be located through a sealed portion where multiple layers are sealed together, in order to maintain the integrity of the sealed interior. Additionally, these types of cuts not only propagate tears on opposite sides of the package, but they also produce multiple pieces of waste.

Traditional crosslinked POF films may be used as shrink-wrap films because crosslinked polymers exhibit increased tensile strength and improved durability. Other benefits of crosslinked POF film include increased puncture resistance (due to improved strength), strong seals at the seams of the shrink-wrap film, and ability to use thinner films without reduced strength. Traditional crosslinked POF films have been favored in the art because of these benefits, along with cosmetic benefits related POF. But when traditional crosslinked POF film is removed from a package (e.g., by tearing the film), the crosslink structure is strong enough to make tear lines unpredictable and not easy to control. To compensate for this unpredictability, the film can be removed using perforations to guide the tears, but perforations in traditional crosslinked POF film have the same downsides as the perforations discussed above related to PET and OPP.

In contrast, a non-crosslinked POF film as described herein can be used to shrink-wrap a box, product, or package, and the non-crosslinked POF shrink-wrap film can be easily removed without any perforations or underlying protective layers. By foregoing the crosslink structure, the underlying parallel paths of the POF are not as strongly connected to each other. The parallel paths extend in the machine direction of the POF film. This effectively creates lines of weakness extending in the machine direction, since the crosslinking structure that might otherwise be strengthening the film transverse to the machine direction is not present. Heat can be applied to shrink the shrink-wrap the film around a box, for example. And where the machine direction of the film coincides with a long corner forming an edge of the box, the film stretches around the corner, stretching the parallel POF structure transverse to its machine direction. This exacerbates the lines of weakness within a high-strain area of the film near the edge. Embodiments described herein leverage this combination of features to locate tear-initiating cuts within these high-strain areas, so that when the film is pulled, the cuts create parallel tear paths within these high-strain areas that propagate in parallel in the machine direction.

In some embodiments, crosslinked POF film may be used to similar effect as non-crosslinked POF film if it is doped with tear-alignment additives. The tear-alignment additives may be used in one or more doped interlayers between outer layers. The tear-alignment additives affect the properties of the crosslinked POF such that the crosslinked POF tears in straight lines parallel to and perpendicular to the machine direction and does not taper inward or exhibit the unpredictable tearing associated with traditional crosslinked POF. As used herein, doped crosslinked POF refers to crosslinked POF that includes a tear-alignment additive.

These and other embodiments are discussed below with reference to FIGS. 1-8. However, those skilled in the art will readily appreciate that the detailed description given herein with respect to these figures is for explanatory purposes only and should not be construed as limiting.

Figure 4:
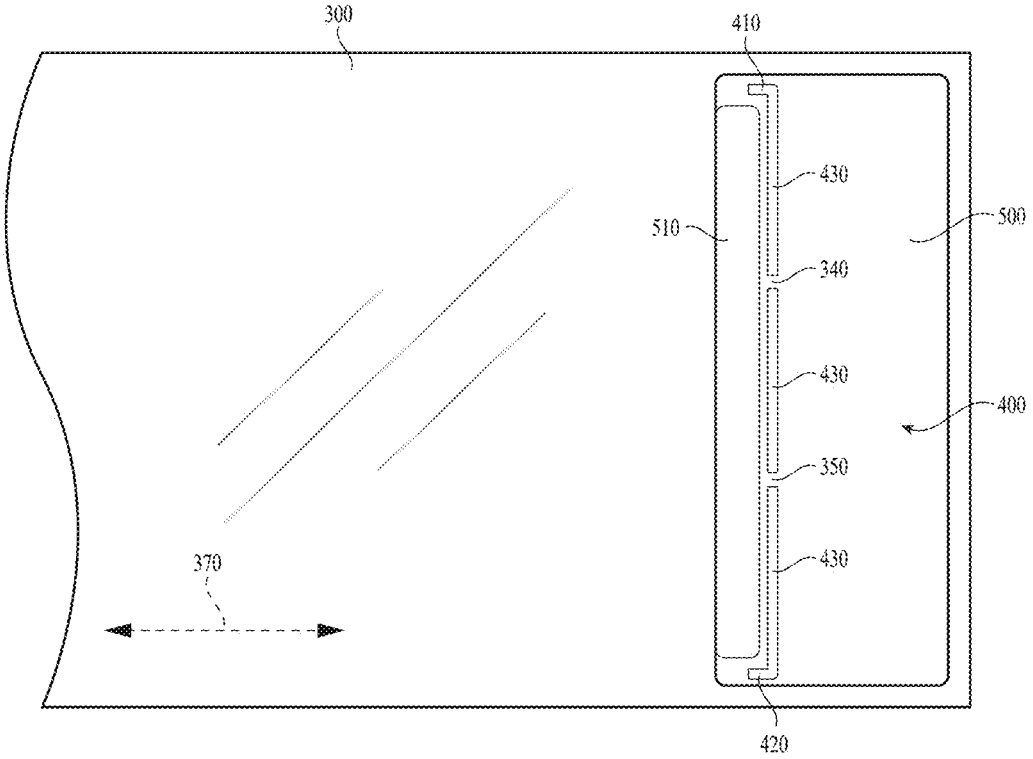
FIG. 4 shows a detailed view of the tab shown in FIG. 1.

FIG. 1 shows an example product package 100 that includes a box 200 covered in a POF shrink-wrap film 300. Box 200 may be made of, for example, a cellulose-based material. In some embodiments the thickness of shrink-wrap film 300 is between 5 micron and 50 micron (e.g., 10 micron, 20 micron, 30 micron, or 40 micron). Shrink-wrap film 300 is translucent, so that the underlying box 200 is visible through it. Product package 100 also includes a tab 500 that can be pulled to start the removal process of the film. In some embodiments, the cuts 400 are overlaid by tab 500. As shown in FIG. 1, only film 300, tab 500, and the underlying box 200 are visible to a customer. In some embodiments, as shown in FIG. 4, tab 500 is translucent and cuts 400 and adhesive strip 510 are visible to a customer. Box 200 may be completely covered by shrink-wrap film 300, except where the film has been cut to create tear-initiating cuts, discussed below.

The POF shrink-wrap film 300 can be removed by pulling tab 500. Pulling tab 500 applies force 710 to film 300 in a direction away from box 200 that initiates two tears (e.g., a first tear 310 and a second tear 320 shown in FIG. 2) that propagate along the length of the box 200 in machine direction 700. Tab 500 can be pulled using a single hand with minimal force required by a user. Additionally, tab 500 may connect between first tear 310 and second tear 320, which can transfer the force on tab 500 to first tear 310 and second tear 320 simultaneously. Tab 500 may be made of a material that is stiffer (i.e., has greater rigidity) than film 300. Tab 500's stiffness may be sufficient that it does not bend when a user pulls it. Such stiffness transfers force 710 uniformly across film 300 from tab 500 and drives first tear 310 and second tear 320 to begin propagating as the same time and continue propagating without interruption at the same rate. In some embodiments, tab 500 is made of a material that has a stiffness of at least 2 times (e.g., at least 3 times, at least 5 times, or at least 10 times) the stiffness of film 300. In some embodiments, tab 500 is at least 25% (e.g., at least 50%, at least 75%, or at least 100%) more stiff than film 300.

Figure 2:
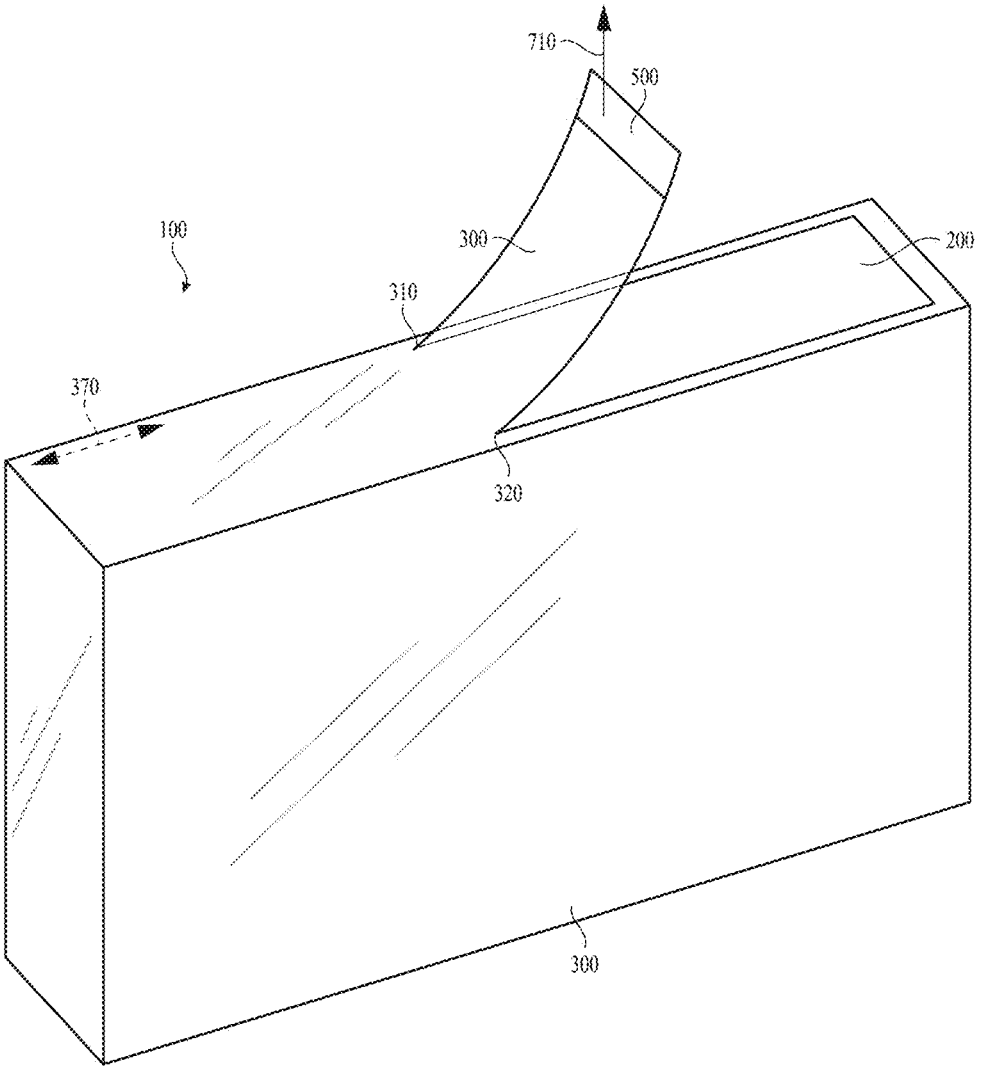
FIG. 2 shows a partial removal of the shrink-wrap film from the product package of FIG. 1.

First tear 310 and second tear 320 may be linear and parallel and propagate along the same side of box 200. As shown in FIG. 2, while tab 500 is being pulled, film 300 tears along a first tear 310 and a second tear 320, exposing a surface of box 200. As illustrated by comparing FIG. 1 and FIG. 2, first tear 310 and second tear 320 only form after tab 500 has been pulled. As force 710 is applied by pulling tab 500, first tear 310 and second tear 320 extend farther along the length of box 200.

Figure 3:
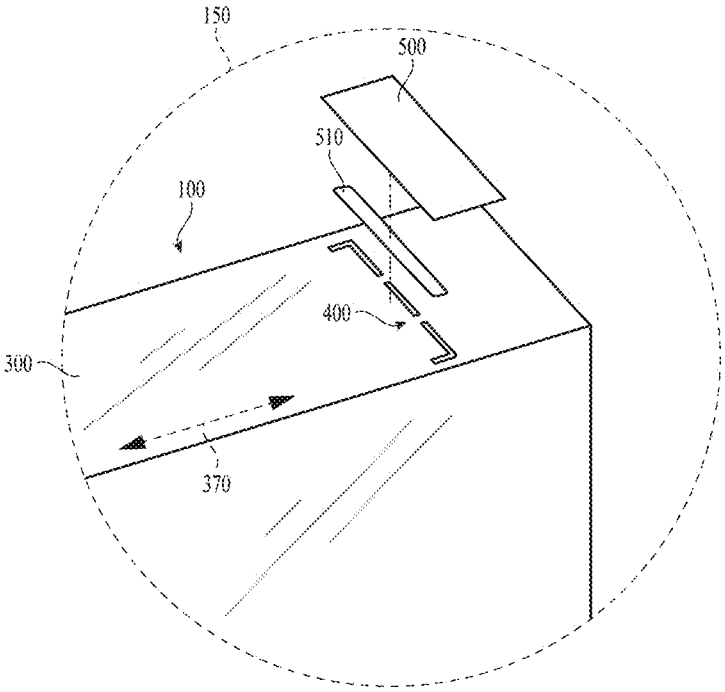
FIG. 3 shows an exploded view of the tab shown in FIG. 1.

Shrink-wrap film 300 tears due to tear-initiating cuts in the film underneath the tab. The tear-initiating cuts are positioned to form a specific cut geometry that takes advantage of the above-discussed properties of non-crosslinked POF film and doped crosslinked POF film. For example, FIGS. 3 and 4 show cut 400 in film 300. FIG. 3 shows an exploded view of region 150 of FIG. 1. As shown in FIG. 3, an adhesive strip 510 is adhered to film 300 in a position partially surrounded by cut 400. In some embodiments, adhesive strip 510 is a pressure-sensitive adhesive. In some embodiments, as shown in FIGS. 1 and 3, tab 500 is opaque and adhered to adhesive strip 510 and positioned to cover cuts 400 and adhesive strip 510. Because of the position of tab 500, when tab 500 is opaque, adhesive strip 510 and cuts 400 are hidden from view. In some embodiments, tab 500 is transparent or translucent such that adhesive strip 510 and cuts 400 are visible to a customer.

Cut 400 can be formed of multiple cuts. For example, cut 400 can include three separate cuts, as shown in the detail view of FIG. 4, in which, for clarity of illustration, tab 500 is shown transparent: first cut 410 extending in machine direction 700, second cut 420 extending in machine direction 700, and third cut 430 extending transverse to machine direction 700. In some embodiments, third cut 430 includes multiple spaces, or gaps, along the length of the cut. These gaps are each made up of film 300. Gaps in the cuts, such as a first gap 340 and a second gap 350, serve to both prevent accidental tearing of film 300 until the customer pulls tab 500 and prevent contaminants (e.g., dust and other particulates) from entering product package 100 underneath film 300. Because such gaps occur in the transverse portion of cut 400 (i.e., in third cut 430), they break once, simultaneously when force 710 is applied, and therefore do not create similar repeated noise as described above with respect to perforated tear paths. As shown in FIG. 4, first gap 340 and second gap 350 are spaced at roughly equal intervals along third cut 430. This is an example gap spacing; other spacing may be used to similar effect.

In some embodiments, as shown in FIG. 4, cut 400 comprises a symmetric geometry. First cut 410 connects with a first end of third cut 430 to form an L-shaped cut at their connection point, and second cut 420 connects with a second end of third cut 430 to form an L-shaped cut at their connection point. First gap 340 and second gap 350 may be on opposite sides of the axis of symmetry. In some embodiments, first cut 410 has a length of between 0.5 mm and 10 mm (e.g., 1 mm to 5 mm) and second cut 420 has a length of between 0.5 mm and 10 mm (e.g., 1 mm to 5 mm). First cut 410, second cut 420, and third cut 430 may each have a width of 0.1 mm to 1 mm. First tear 310 and second tear 320 may have a length of at least 5 times (e.g., at least 7 times, at least 10 times, or at least 15 times) the length of first cut 410 and second cut 420, respectively.

The cut geometry can be varied and have one or more cuts (e.g., 1 cut, 2 cuts, 3 cuts, 4 cuts, or 5 cuts). In some embodiments, cut 400 comprises a trapezoidal cut geometry. For example, first cut 410 may connect with a first end of third cut 430, but unlike the L-shaped cut at the connection point, the connection between first cut 410 and third cut 430 may connect to create a first obtuse angle. Second cut 420 similarly can connect with a second end of third cut 430 to create a second obtuse angle, in the opposite direction of the first obtuse angle. In some embodiments, cut 400 comprises a U-shaped cut geometry. For example, the U-shaped cut geometry may be a continuous curve from third cut 430 to first cut 410 and from third cut 430 to second cut 420. The cut geometry can comprise any geometric shape (e.g., trapezoidal, curved, straight, L-shaped, or any combination of those). In any case, regardless the size, shape, or orientation of the cut geometry, the cut geometry ensures that the tears (e.g., first tear 310 or second tear 320) initiate and propagate in straight lines down the box.

Figure 5:
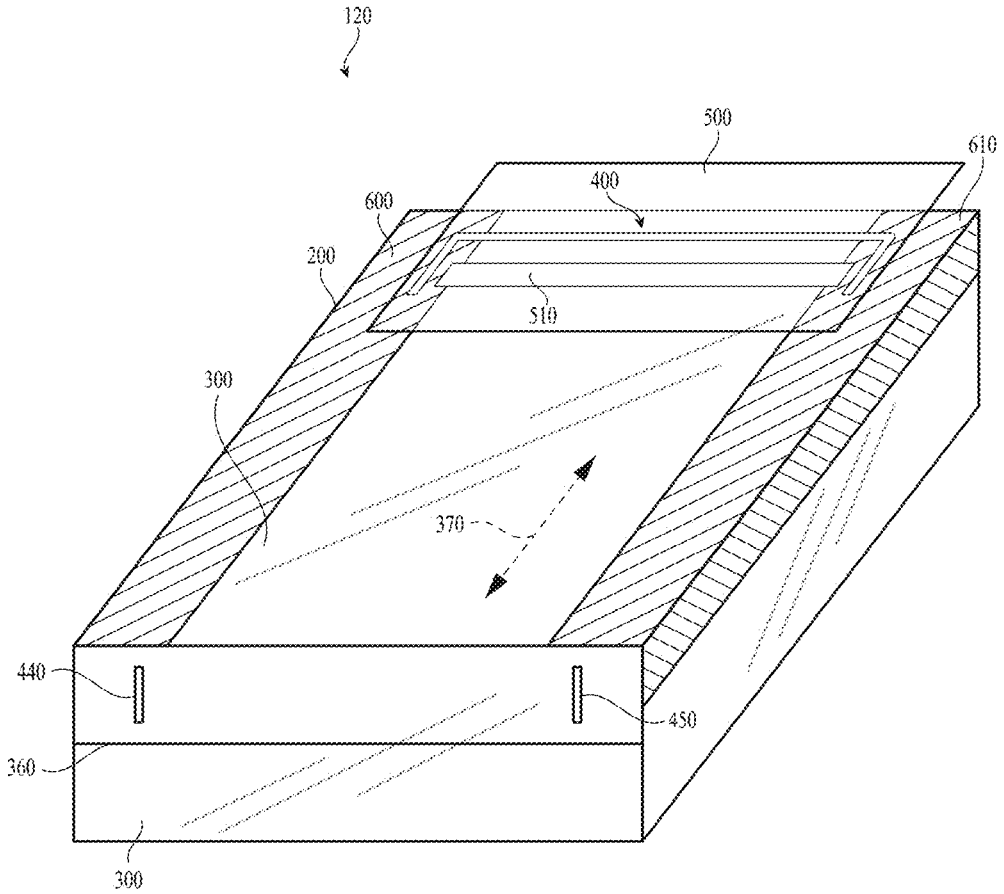
FIG. 5 shows another exemplary product package covered by a polyolefin shrink-wrap film.
Figure 6:
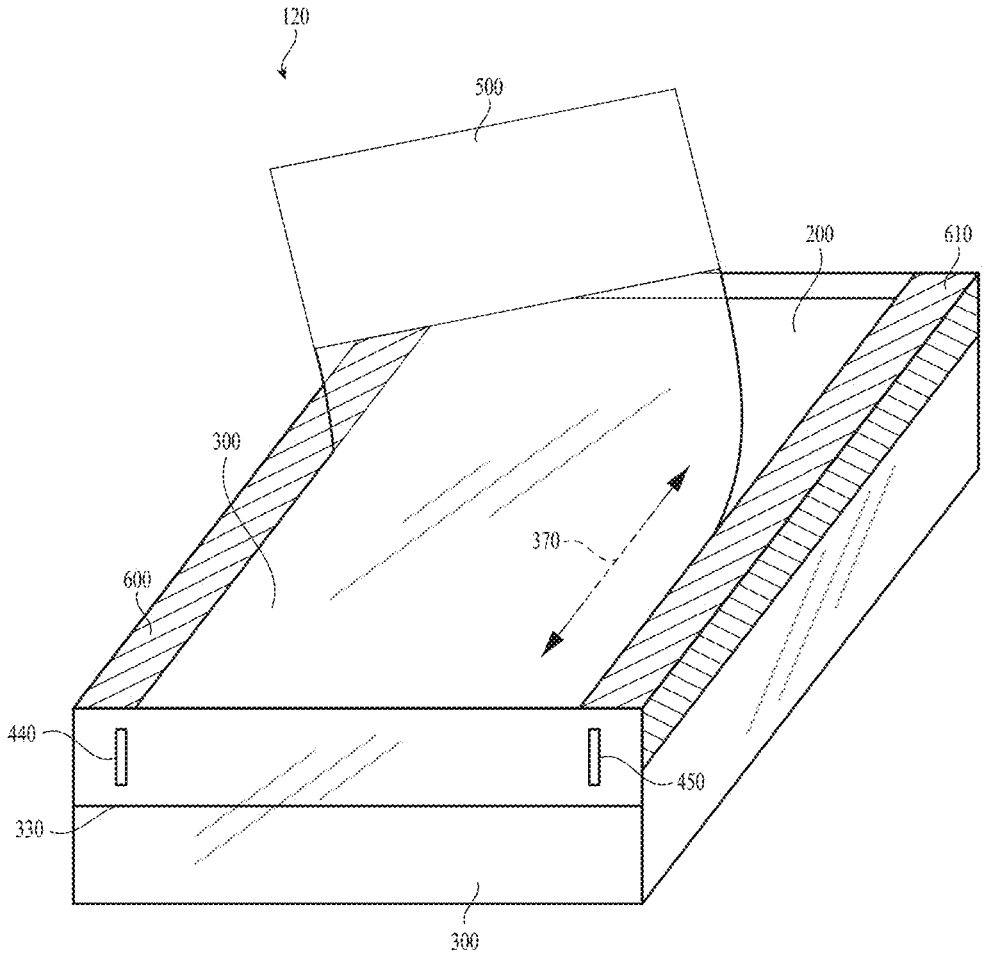
FIG. 6 shows a partial removal of the shrink-wrap film from the product package of FIG. 5.

In some embodiments, film 300 includes one or more cuts on a second side of box 200. For example, as shown in FIGS. 5 and 6, a fourth cut 440 and a fifth cut 450 are positioned on a second side of box 200, different from the side on which cut 400 is. (For clarity of illustration, tab 500 is shown transparent in FIG. 5.) Once tab 500 has been pulled so that first tear 310 and second tear 320 have extended along the entire length of the first side of box 200, fourth cut 440 and fifth cut 450 function to guide first tear 310 and second tear 320 along the second side of box 200, which can help to further release box 200 from film 300.

First tear 310 and second tear 320 tear along the edges of box 200 in straight, parallel lines. Especially, for non-crosslinked POF embodiments, this is in part due to high-strain areas that form near the edges of box 200 when film 300 is heated to shrink film 300 to box 200. FIGS. 5 and 6 show an example product package 120 and illustrate some high-strain areas with hatching lines. Similar high-strain areas exist in product package 100 as described above with respect to FIGS. 1-4. FIGS. 5 and 6 show the position of a first high-strain area 600 and a second high-strain area 610. The hatching in FIGS. 5 and 6 is used only to illustrate the positions of first high-strain area 600 and second high-strain area 610. First high-strain area 600 and second high-strain area 610 are not visibly distinct from the other areas of film 300. The high-strain areas extend along the length of box 200 in machine direction 370 of film 300 and help to guide first tear 310 and second tear 320. The high-strain areas are created by tension as film 300 stretches around the corners at edges of the package, and the tension in the high-strain area serves to anchor film 300 to box 200, even as force is applied to pull tab 500.

Figure 7:
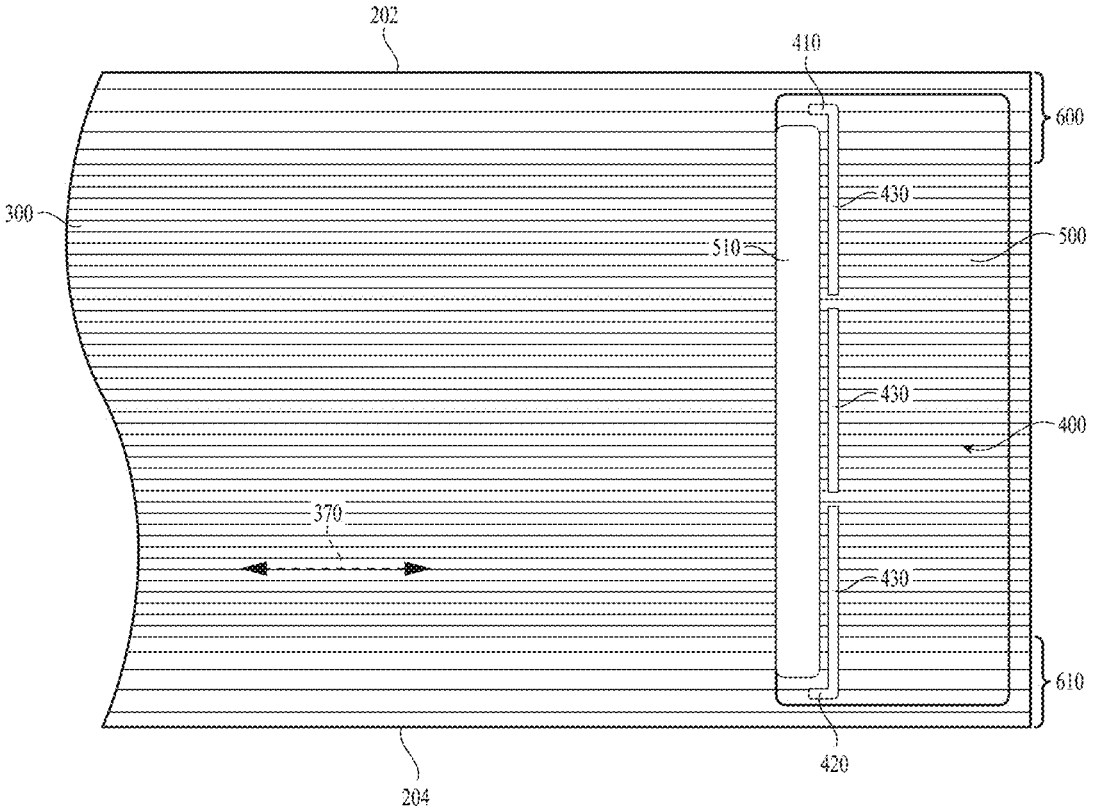
FIG. 7 shows high-strain areas formed in the film at the edges of a product package.

FIG. 7 provides a conceptual illustration of how high-strain areas may work to help guide tears according to some embodiments. For clarity of illustration, tab 500 is shown transparent. Chains of polymers are generally oriented in the machine direction, thus aligning their paths of least resistance in the machine direction. FIG. 7 illustrates parallel lines extending in machine direction 370. The increased spacing of the lines in FIG. 7 indicates areas under higher strain (i.e., gradient of strain increases as spacing of lines increases). The strain increases within high-strain areas 600 and 610 as the position of shrink-wrap film 300 approaches edges 202 and 204 of box 200.

Adjacent polymer chains within these stretched high-strain areas 600 and 610 are under greater strain than in other areas of shrink-wrap film 300. When tab 500 is pulled, tears will propagate down the path of least resistance, which, due to the polymer structure aligning in the machine direction, will propagate the tears in machine direction 370. This is believed to be due to the fine crystallinity structure of non-crosslinked film, and low bond strength between polymer chains.

The general effect of the higher strain in shrink-wrap film 300 as it stretches around edges 202 and 204 is to help the tear paths stay straight, within the high-strain area. Specifically, as the tension in the high-strain area increases, the POF material in that area thins, and an increased force develops in the transverse direction towards the edge of the box. This force overrides any force due to transverse bonds of the polymer chains that would otherwise pull the tear paths toward each other. Thus, first tear 310 and second tear 320 follow straighter tear paths, guided by lines of weakness between adjacent polymer chains within high-strain areas 600 and 610.

Additionally, as the heating time of film 300 (discussed below) increases, the tension in the high-strain areas increases. A high-strain area of shrink-wrap film 300 is an area under sufficiently great strain as to guide tear paths parallel with machine direction 370 in the manner described herein. For example, a high-strain area at an edge of product package 100 may be an area under a strain that is greater than 125% of a strain in the shrink-wrap film at a position equidistant from the edge and an adjacent edge. In some embodiments, a high-strain area extending from an edge of box 200 has a width that extends between 1.5 mm and 6 mm from the edge.

Thus, the high-strain areas allow for the non-crosslinked POF (e.g., film 300) to easily tear along straight, parallel paths inside the high-strain areas and in the machine direction when a customer pulls tab 500. As discussed above, traditional crosslinked POF has typically been used in shrink-wrap application, but traditional crosslinked POF films are uncontrollable when torn without additional perforating cuts. As such, if a traditional crosslinked POF was torn as described related to non-crosslinked POF above, the tears would start at the pair of cuts, but then the center force would cause the tears to taper towards the center. This would bring the two tears together toward the center of box 200, forming a V-shape where the tear paths ultimately merge prematurely. This V-shape prevents the tears from extending continuously along the length of the box.

Further, as shown in FIG. 7, for non-crosslinked POF, the strain of polymer chains of the shrink-wrap film increases within high-strain areas 600 and 610 toward edges 202 and 204. This spacing gradient helps to discourage tear paths from wandering more centrally, for example, due to an unequal application of force on tab 500 or a tendency to move in the direction of the force, which may be applied centrally to the tab 500 (e.g., from a customer pulling the tab), especially if tab 500 bends in accommodation of the centralized force applied to it. Together, the stiffness of the tab 500 distributes the force to the edges of box 200, and the lines of weakness represented in FIG. 7 combine to help keep tear paths propagating along parallel, linear lines within the high-strain areas.

In some embodiments, film 300 can be a multilayered film and other layers may improve the properties of the non-crosslinked POF film. For example, the strength of the non-crosslinked POF film can be improved by using a multilayered film.

In some embodiments, a doped crosslinked POF (i.e., crosslinked POF that includes a tear-alignment additive) may be used instead of a non-crosslinked POF. The doped crosslinked POF may be used in a similar manner as the non-crosslinked POF embodiments described above. The tear-alignment additive may be part of one or more doped interlayers, or the additive may be incorporated within the film itself. In either case, the additive affects the properties of the crosslinked POF such that the straight tears can propagate in the machine direction or perpendicular to the machine direction of the doped crosslinked POF film without tapering or otherwise deviating from a straight line (e.g., as discussed above related to traditional crosslinked POF). For example the, additive may affect the crystallinity of the crosslinked POF to enable straight tears in the machine direction of the film or perpendicular to the machine direction of the film. In some embodiments, the doped crosslinked POF may include numerous layers (e.g., 3 layers, 5 layers, 7 layers, 10 layers, 15 layers, 20 layers, 25 layers, or 30 layers). One or more of the layers may be doped with the tear-alignment additive.

The doped crosslinked POF is tension independent, which means the doped crosslinked POF does not rely on the above-described high-strain areas for tearing straight and will tear straight in the machine direction or perpendicular to the machine direction independent of the strain at the location of the tear-initiating cuts. In some embodiments, the tear initiating cuts have a similar cut geometry as those discussed above related to non-crosslinked POF (e.g., as show FIGS. 3, 4, 5, and 7).

Figure 8:
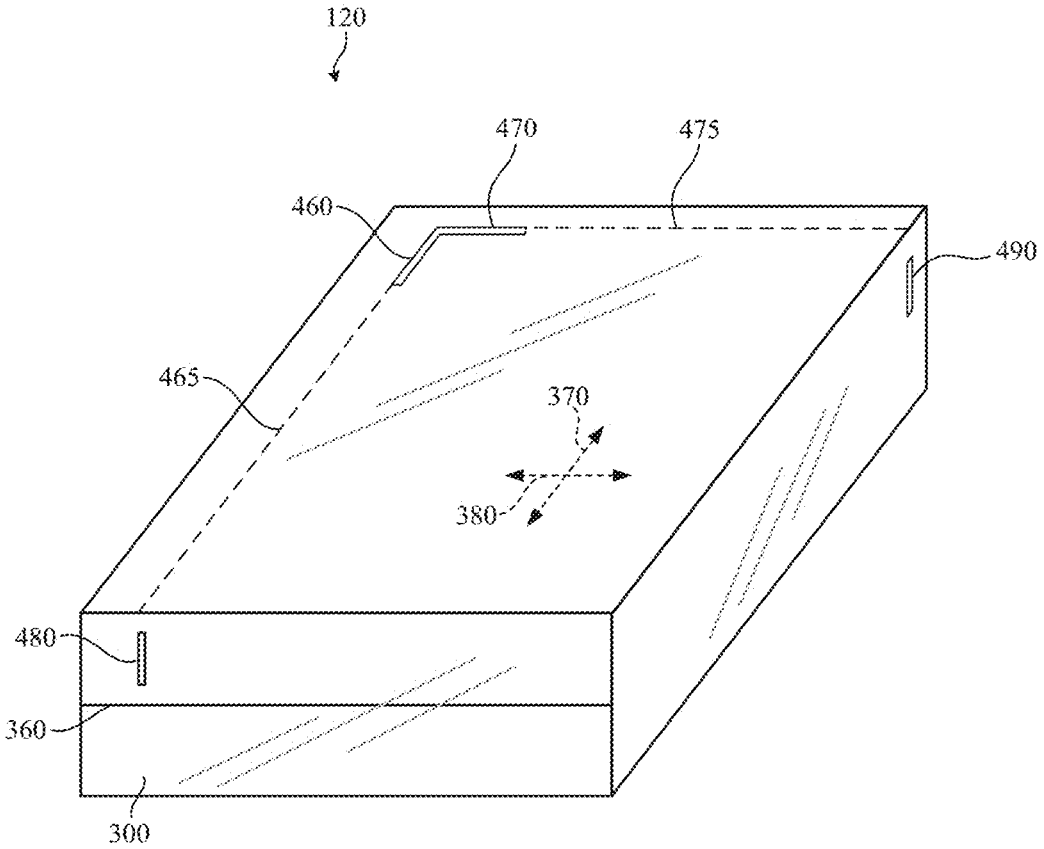
FIG. 8 shows another exemplary product package covered by a polyolefin shrink-wrap film.

Because the doped crosslinked POF can tear straight not only in the machine direction, but also perpendicular to the machine direction, additional cut geometries are possible. For example, in some embodiments, the tear initiating cuts are oriented to form the geometry as shown in FIG. 8. As shown in FIG. 8, cut 460 extends in the machine direction of film 300 (i.e., in the direction of arrow 370), and cut 470 extends perpendicular to the machine direction of film 300 (i.e., in the direction of arrow 380). As shown in FIG. 8, cuts 460 and 470 are positioned to form an L-shaped cut geometry. In some embodiments, a tab may be positioned to cover cuts 460 and 470, similar to tab 500 shown in FIGS. 1-7. When force is applied upward in a direction away from box 200 at the position of cuts 460 and 470, film 300 will begin to tear along paths illustrated by first tear path 465 and second tear path 475. It is understood that first tear path 465 and second tear path 475 are not visible in film 300, but rather are shown in FIG. 8 for clarity. As force continues to be applied after the tears begin, the tears propagate along the entire length and width of box 200. In some embodiments, box 200 includes cuts 480 and 490, which function similar to fourth cut 440 and fifth cut 450, discussed above.

Box 200 may be a packaged product shrink wrapped according to various methods. Box 200 may be wrapped with a non-crosslinked POF of a doped crosslinked POF. In some embodiments, the method of shrink-wrapping involves orienting the box so that its areas along which tear paths are intended to be created align with the machine direction (for non-crosslinked POF) and/or are perpendicular to the machine direction (for doped crosslinked POF), wrapping the box with the film, and heating the film to shrink the film. The film may be heated in an oven at a temperature between 120° C. and 150° C. (e.g., between 130° C. and 140° C.) for 10 seconds to 35 seconds (e.g., for 20 seconds to 25 seconds). The shrinking of the film creates the high-strain areas discussed above (e.g., first high-strain area 600 and second high-strain area 610) at the corners of the box.

Especially for non-crosslinked POF embodiments, the degree of strain within high-strain areas 600 and 610 can be influenced by focused application of heat to these areas during or as a separate operation from the shrink-wrap operation. For example, if higher strain is desired along corners of product package 100 or 120 than would be attendant to the normal heat-shrinking operation, focused blasts of hot air may be applied along these corners to thin the POF and increase the strain in these areas.

After the film has been heated to create a shrink-wrapped film around the box, a hot knife may be used to cut a series of cuts in the film. This cutting step may include applying a vacuum to an area of the film to pull that area and its surrounding area of the film away from contact with the box, extending a hot knife through the film to cut one or more cuts, then removing the vacuum so the film is released back in contact with the box. In some embodiments, the cutting step involves using the hot knife to cut a first cut, a second cut, and a third cut (e.g., cuts 410, 420, and 430 as shown in FIG. 4). The cuts can have varied geometry, such as those shown in FIGS. 3-5 and 7-8. Additionally, all of the cuts may be made without damage to the underlying box, even when a protective layer is not used between the film and the box. Specifically, by pulling the film away before making the cuts, the material of the box is kept at a distance from the cutting implement, thereby keeping it from being marred or otherwise impacted by the cutting operation.

Following the cutting step, a tab (e.g., tab 500 shown in FIGS. 1-6) may be positioned to cover the cuts made by the hot knife. In some embodiments, the method includes adding a pressure-sensitive adhesive (e.g., adhesive strip 510 shown in FIGS. 3-4) to the film prior to applying the tab. The pressure-sensitive adhesive affixes the tab to the film and prevents the tab from separating from the film when force is applied by a user to pull the tab. The tab is adhered to the film only on one side of the cut (the side forming the portion to be torn away, see, e.g., FIGS. 2 and 4), so the other side is free to be grasped and pulled by a customer removing the film, as described above. In other words, the adhesive does not bridge the cut, and adhesive is not applied on opposite sides of the cut.

Once a product package has been prepared as described above, the product package may be sold by a retailer to a customer. The customer's interaction with the package starts with pulling tab 500. As the customer pulls tab 500, force is applied to the film away from box 200. Once sufficient force is applied, first gap 340 and second gap 350 break (see, e.g., FIGS. 1-4).

After first gap 340 and second gap 350 break, as the customer continues to pull tab 500, first tear 310 and second tear 320 form in the machine direction of the film (e.g., machine direction 370 shown in FIG. 5) within high-strain areas along the edges of the box (e.g., along first high-strain area 600 and second high-strain area 610 shown in FIGS. 5 and 6). The customer continues to pull tab 500 until first tear 310 and second tear 320 extend along the entire length of box 200. In some embodiments, the customer continues to pull tab 500 until first tear 310 and second tear 320 continue to tear down a second side of box 200. As the tears develop on the second side of box 200, first tear 310 finds fourth cut 440 and second tear 320 finds fifth cut 450, and fourth cut 440 and fifth cut 450 guide the tears to the end of the second side. In some embodiments, the tears cross a seam 360 in film 300. After that, the customer can remove box 200 from film 300, in some cases leaving a single piece of waste.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

What is claimed is:

1. A packaged product, comprising:

a product packaged in a box;

a non-crosslinked polyolefin shrink-wrap film around the box, the shrink-wrap film comprising cuts in the shrink-wrap film, wherein the cuts comprise a first cut oriented in a machine direction of the shrink-wrap film, a second cut oriented in the machine direction of the shrink-wrap film, and a third cut oriented perpendicular to the machine direction of the shrink-wrap film, wherein the third cut connects to the first cut and the second cut; and a tab affixed to the shrink-wrap film extending between the first cut and the second cut, wherein the tab overlays the first cut, the second cut, and the third cut, wherein when the tab is pulled a first tear forms at the first cut, a second tear forms at the second cut, and both the first tear and the second tear propagate continuously in straight, parallel lines along the length of a first side of the box in the machine direction of the shrink-wrap film, and wherein the shrink-wrap film between the first tear and the second tear on the first side of the box is a single layer of the shrink-wrap film.

2. The packaged product of claim 1, wherein the first cut, the second cut, and the third cut are the only openings in the shrink-wrap film.

3. The packaged product of claim 1, wherein:

the first tear is at least ten times longer than the first cut, and the second tear is at least ten times longer than the second cut.

4. The packaged product of claim 1, wherein the shrink-wrap film further comprises:

a first high-strain area along a first edge of the box in the machine direction of the shrink-wrap film; and a second high-strain area along a second edge of the box in the machine direction of the shrink-wrap film, wherein the first tear is formed in the first high-strain area, and wherein the second tear is formed in the second high-strain area.

5. The packaged product of claim 4, wherein each of the first high-strain area and the second high-strain area is under a strain that is greater than 125% of a strain in the shrink-wrap film at a position equidistant from the first edge and the second edge.

6. The packaged product of claim 4, wherein the first high-strain area has a width that extends between 1.5 mm and 6 mm from the first edge of the box, and wherein the second high-strain area has a width that extends between 1.5 mm and 6 mm from the second edge of the box.

7. The packaged product of claim 4, wherein the first high-strain area and the second high-strain area each have a width equal to 2% to 25% of a width of the box.

8. The packaged product of claim 1, wherein:

the first cut has a length of between 1 mm and 5 mm, and the second cut has a length of between 1 mm and 5 mm.

9. The packaged product of claim 8, wherein the third cut has a length of between 10 mm and 20 mm.

10. The packaged product of claim 9, wherein each of the first cut, the second cut, and the third cut has a width of 0.1 mm to 1 mm.

11. The packaged product of claim 1, wherein the box shows no visible marking from the formation of the first cut, the second cut, and the third cut, and wherein the box is made from a cellulose-based material.

12. The packaged product of claim 1, further comprising:

gaps in the third cut, such that the third cut is formed in multiple cut segments separated by the gaps, wherein shrink-wrap material forming the gaps is broken simultaneously when the tab is pulled.

13. The packaged product of claim 1, wherein the first tear and the second tear each propagate along the entire length of a first side of the box.

14. The packaged product of claim 13, wherein the first tear and the second tear each propagate along the entire length of a second side of the box to release the shrink-wrap film from the box, wherein the second side is perpendicular to the first side.

15. The packaged product of claim 1, wherein the cuts are on the first side of the box.

16. A packaged product, comprising:

a product packaged in a packaging container;

a polyolefin shrink-wrap film covering the packaging container, the shrink-wrap film comprising:

a pair of tear-initiating cuts, each extending in a machine direction of the shrink-wrap film;

a connecting cut extending between and connecting to each of the pair of tear-initiating cuts, wherein the shrink-wrap film is configured to tear from the tear-initiating cuts to create a pair of parallel tear paths extending along the length of a first side of the packaging container in the machine direction of the shrink-wrap film in response to a force applied to the shrink-wrap film between the tear-initiating cuts in a direction away from the packaging container, and wherein the shrink-wrap film extends continuously between and across the tear paths on the first side of the packaging container.

17. The packaged product of claim 16, further comprising a tab positioned to cover the tear-initiating cuts, wherein the force is applied evenly across the connecting cut by the tab as the tab is pulled away from the packaging container.

18. The product of claim 17, wherein a stiffness of the tab is at least twice as stiff as a stiffness of the shrink-wrap film.

19. The packaged product of claim 16, further comprising a first high-strain area and a second high-strain area, wherein:

the first high strain area extends along a length of the packaging container from a first edge of the packaging container to a first one of the parallel tear paths, and the second high strain area extends along the length of the packaging container from a second edge of the packaging container to a second one of the parallel tear paths.

20. The packaged product of claim 16, wherein each of the tear-initiating cuts is disposed less than 10 mm from an edge of the packaging container.

21. The packaged product of claim 16, wherein the polyolefin shrink-wrap film is a non-crosslinked polyolefin shrink-wrap film.

22. The packaged product of claim 21, wherein each of the tear-initiating cuts is disposed adjacent to an edge of the packaging container.

23. The packaged product of claim 16, wherein the polyolefin shrink-wrap film is a multilayer film.

24. A packaged product, comprising:

a product packaged in a packaging container;

a polyolefin shrink-wrap film covering the packaging container, the shrink-wrap film comprising:

a first tear-initiating cut extending in a machine direction of the shrink-wrap film;

a second tear-initiating cut extending perpendicular to the machine direction of the shrink-wrap film, wherein, in response to a force applied in a direction away from the packaging container, the shrink-wrap film is configured to tear from the first tear-initiating cut along a first path extending in the machine direction of the film and from the second tear-initiating cut along a second path extending perpendicular to the machine direction of the film.

25. The packaged product of claim 24, wherein an end of the first tear-initiating cut connects to an end of the second tear-initiating cut to form an L-shaped cut.

26. The packaged product of claim 24, wherein the polyolefin shrink-wrap film is a crosslinked polyolefin comprising a tear-alignment additive.

* * * * *